US005400560A

United States Patent [19]

Hellwig et al.

[11] Patent Number: 5,400,560

[45] Date of Patent: Mar. 28, 1995

[54] OFFICE PANEL ELEMENT CONFIGURATION

[75] Inventors: John Hellwig, Toronto; Tori Kasdorf, Barrie, both of Canada

[73] Assignee: Teknion Furniture Systems, Downsview, Canada

[21] Appl. No.: 894,853

[22] Filed: Jun. 5, 1992

[51] Int. Cl.[6] ..... E04C 3/00

[52] U.S. Cl. ..... 52/578; 52/821; 52/476; 52/489.1

[58] Field of Search ..... 52/578, 821, 829, 216.1, 52/242, 735, 506, 476, 483.1, 489.1, 773, 588

[56] References Cited

U.S. PATENT DOCUMENTS

| | | | |
|---|---|---|---|
| 741,524 | 10/1903 | Miller | 52/506 |
| 2,490,663 | 12/1949 | Van Uum | 52/489 X |
| 3,053,354 | 9/1962 | Dielman | 52/242 |
| 3,121,977 | 2/1964 | Bersudsky | 52/506 |
| 3,292,328 | 12/1966 | Lewis et al. | 52/483 X |
| 3,378,973 | 4/1968 | Tudor-Pole | 52/716.1 |
| 3,736,717 | 6/1973 | Farley | 52/476 |
| 3,974,608 | 8/1976 | Grearson | 52/476 X |
| 4,129,971 | 12/1978 | Reusser | 52/288 |
| 4,193,245 | 3/1980 | Johnson | 52/735 X |
| 4,353,193 | 10/1982 | Sanderson | 52/476 |
| 4,585,131 | 4/1986 | Crossman | 52/287 R X |
| 4,719,731 | 1/1988 | Ravotti | 52/242 X |
| 4,730,433 | 3/1988 | Ollinger | 52/735 |
| 4,736,559 | 4/1988 | Young | 52/506 X |
| 4,843,771 | 5/1989 | Chapman | 52/288 MF |
| 4,856,253 | 8/1989 | Jou | 52/288 MF X |
| 4,949,519 | 8/1990 | Jeffers | 52/242 X |
| 4,962,612 | 10/1990 | Kuwano | 52/506 |
| 4,995,215 | 2/1991 | Menchetti | 52/489 X |
| 5,039,177 | 8/1991 | Newell | 52/287 R X |
| 5,067,294 | 11/1991 | McGowan | 52/242 X |
| 5,121,578 | 6/1992 | Holz | 52/506 |

*Primary Examiner*—Carl D. Friedman
*Assistant Examiner*—Beth A. Aubrey

[57] ABSTRACT

An element of an office panel includes a back support member closed at either end by molded end pieces. The molded end pieces in combination with the back support member define a front opening recess into which a filler material is inserted. A decorative facing material is applied over the filler material and attached to the back support member and the molded end pieces, whereby the facing material forms a finish face of the element. With this arrangement, the back support member is more easily manufactured, as it is open at either end and the molded end pieces can easily be inserted within the back support member to effectively close the member and provide a complete support for the element. According to an aspect of the invention, the molded end pieces include molded components thereon by means of which the element can be effectively supported by an office panel frame.

12 Claims, 5 Drawing Sheets

OFFICE PANEL ELEMENT CONFIGURATION

FIELD OF THE INVENTION

The present invention relates to office panel elements, sometimes referred to as office panel tiles, which are adapted to cover an office panel frame.

BACKGROUND OF THE INVENTION

Office panelling systems for subdividing office space have become a well recognized approach for effectively subdividing office space and defining various work stations. One of the most popular approaches with respect to office panelling systems is that each office panel has a separate frame to which office panel elements are secured to effectively cover the frame and provide a finished surface. Each frame may be adapted to receive a plurality of office panel elements to one side or to both sides and typically the frames have a plurality of vertical members interconnected by horizontal members or horizontal rail members.

These office panel elements are designed to absorb sound and have a sound absorbing filler material immediately behind the facing material which is often cloth, particularly in the case of sound absorbing elements. A metal back support member provides the recess for receiving and supporting the filler material and has typically been made of a metal, having metal sides and metal ends with the front being open for receiving the filler material. The fabric is then applied over the combination and is typically adhesively secured in a more or less tensioned state to the rear surface of the back support. Each element typically includes a peripheral edge region of shallower depth which overlaps with the frame, with a central area being of greater depth and being received within the recess of the frame. Various clips are secured to the back support and often form a spring detente arrangement maintaining the element within an office panel frame. As can be appreciated, the procedures for manufacturing of the back support require closing of both the sides and ends and complicate the manufacture of the element.

SUMMARY OF THE INVENTION

According to the present invention, an element of an office panel has a back support member which cooperates with molded end pieces received in the back support member, with these molded end pieces effectively closing the ends of the office panel element. A filler material is received within the back support member and a decorative facing member covers the filler material and is attached to the back support member and the molded end pieces whereby the facing material forms a finished face of the element.

According to an aspect of the invention, the back support is of a constant cross section open at either end with the molded end pieces being slidably received at either end of the back support member.

According to yet a further aspect of the invention, the back support member includes locking recesses therein which receive locking members of respective molded end pieces which retain the molded end pieces relative to the backing member when fully received in the back support member.

According to yet a further aspect of the invention, the molded end pieces each include at either end thereof means to cooperate and form a spring detente arrangement used for fastening of the element in an office panel frame.

According to yet a further aspect of the invention, each molded end piece includes a lower hook arrangement for engaging a rail of an office frame and an upper spring detente arrangement for engaging a higher rail of the office frame.

According to yet a further aspect of the invention, the upper spring detente is a resiliently mounted tab having a camming surface thereon for engaging a rail of the office panel frame. In one aspect of the invention, the molded end pieces have a projecting portion of greatly reduced depth relative to the back support member, with this projecting portion defining one edge of the element. This projecting edge is typically a peripheral edge at either end of the back support member.

According to yet a further aspect of the invention, this projecting portion is further reduced at the edge thereof to define a narrow edge strip. This narrow edge strip is used to conceal a fastening arrangement provided at the edge of the office panel.

According to yet a further aspect of the invention, the upper spring detente includes a top facing spring detente and a side outwardly facing spring detente, each of which can be used for engaging a frame member of an office panel frame.

The molded end piece for an office panel element, according to the present invention, has a front face support portion cooperating and merging with a panel edge profile. The molded end piece includes means for engaging a panel backing member and means for releasably engaging and allowing securement of the molded end piece to a panel frame.

According to an aspect of the invention, the molded end piece for an office panel element has a hook arrangement at a lower edge for being placed on a horizontal rail of a panel frame and an upper spring detente arrangement for engaging a further member of the panel frame.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
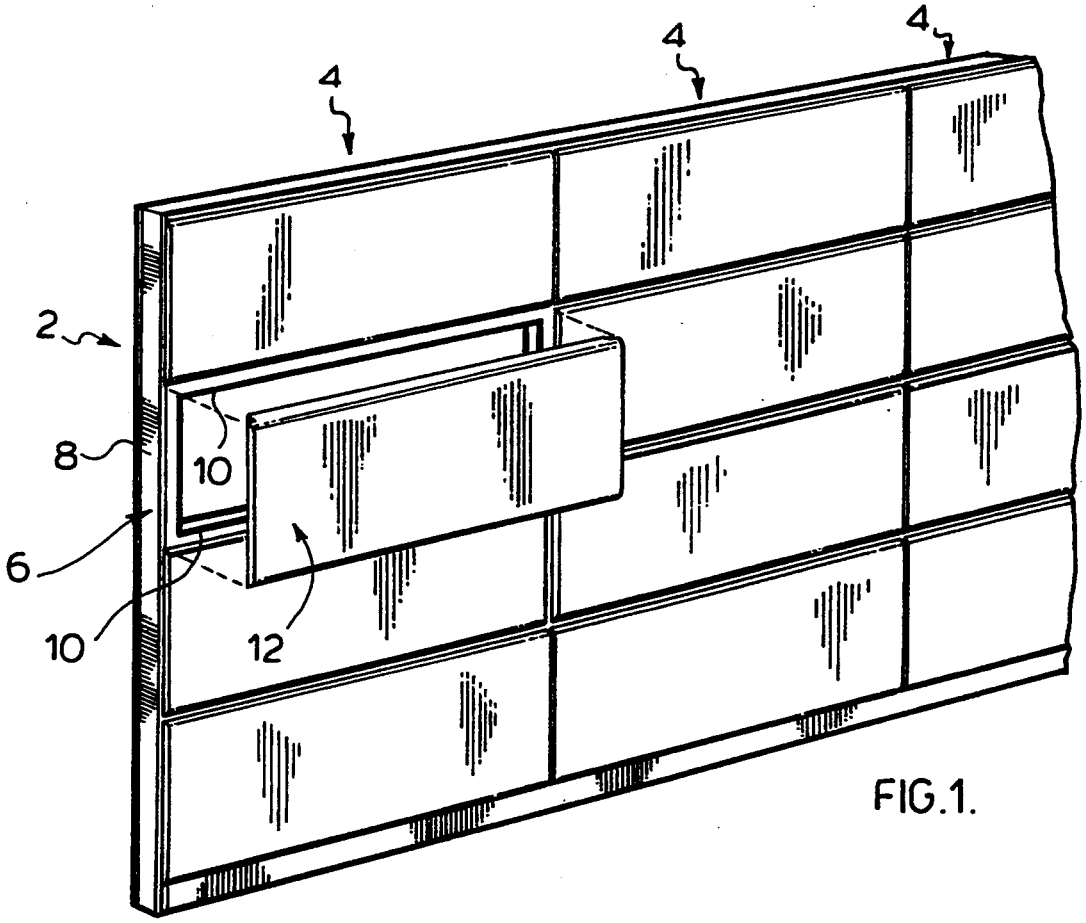
FIG. 1 is a partial perspective view showing a number of office panels and the various elements associated therewith.

The office panelling system, generally shown as 2 in FIG. 1, is made up by interconnecting individual office panels 4 and forming a network. Each office panel 4 has an office panel frame 6. Typically, the office panel frame 6 has vertical members 8 and a number of horizonal rail members 10 which provide the support for the office panels. Office panel elements, generally shown as 12, are removably secured to the office panel frame. A number of office panel frames may be stacked, one on top of the other, and the frames are available in different heights. The most common arrangement uses rectangular elements 12, although some systems do allow the use of larger element, for example, two vertically aligned elements in FIG. 1 could be replaced by a single office element of greater height. Typically, there is a fixed spacing between the horizontal rails to define a modular type arrangement.

Figure 2:
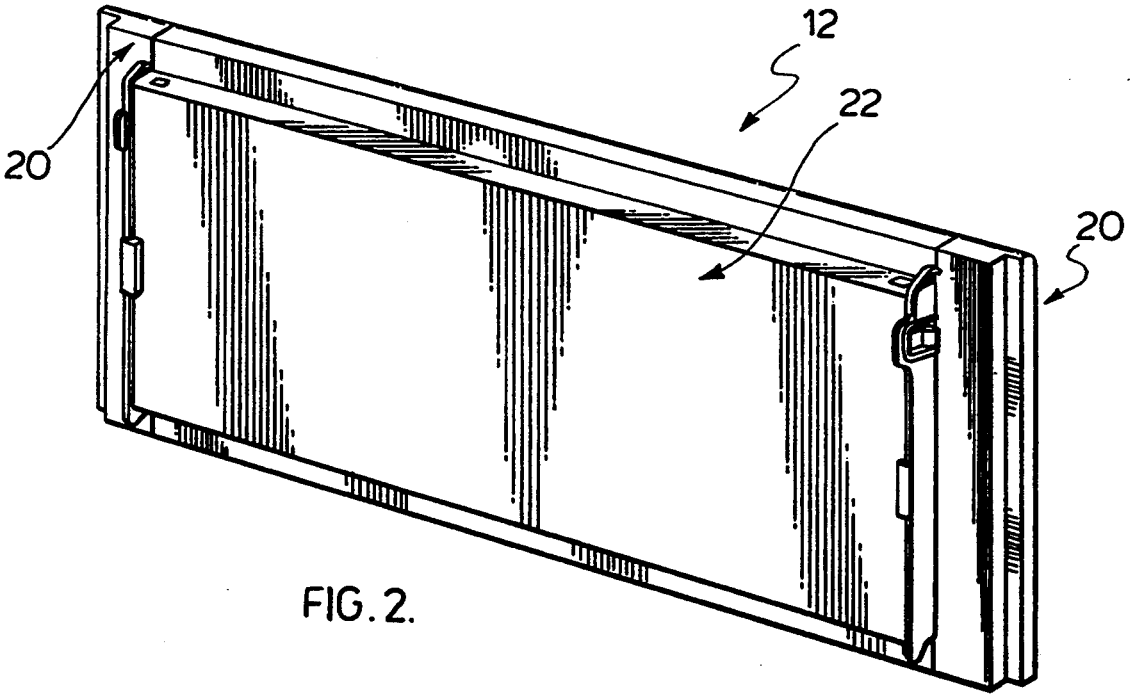
FIG. 2 is a rear perspective view of an office panel element prior to having a facing material applied thereto.
Figure 3:
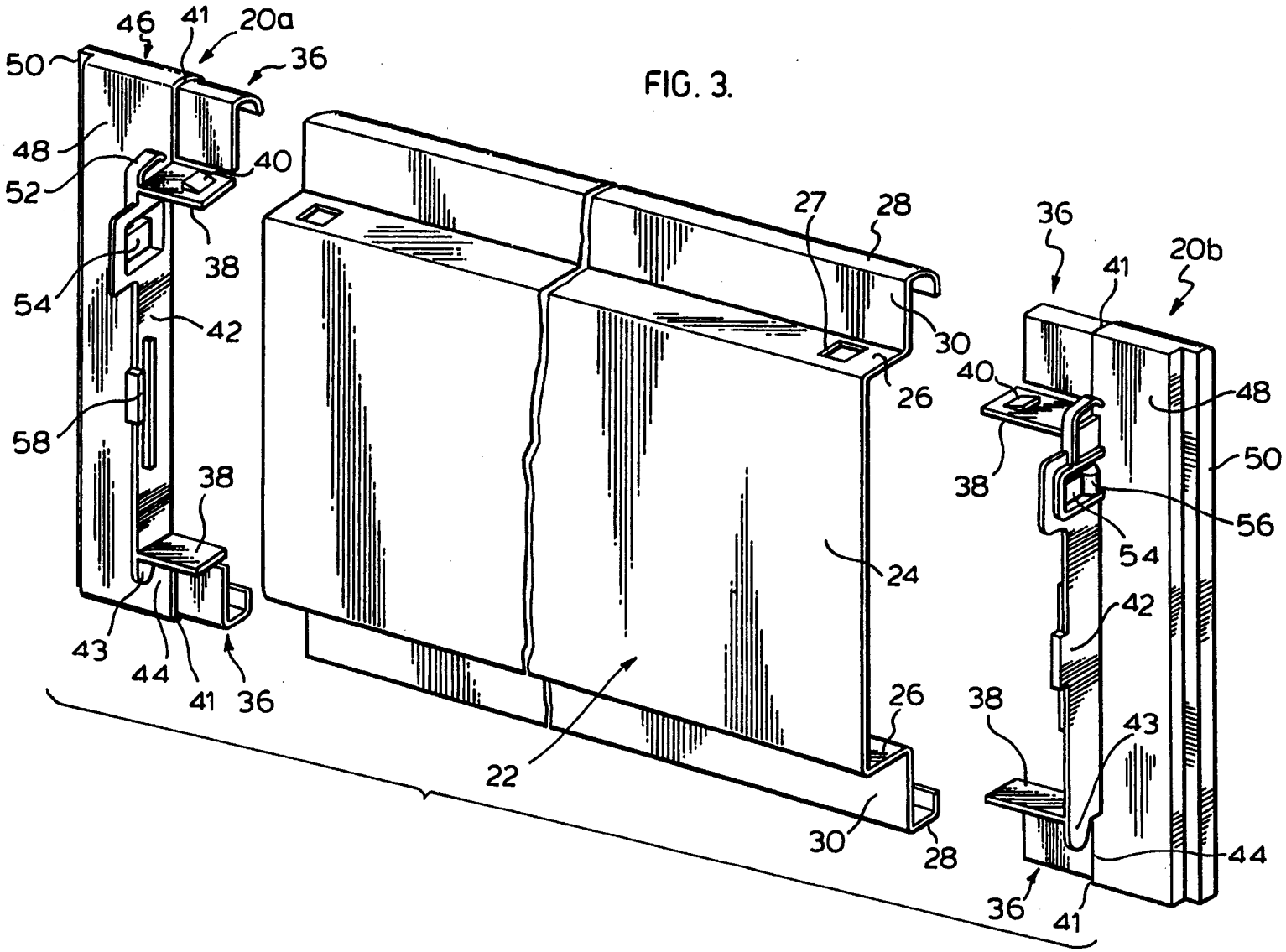
FIG. 3 is an exploded perspective view of the molded end pieces and associated back support member of an office panel element.

The office panel element, as shown in FIGS. 2 and 3, has molded end pieces 20 inserted within the ends of the back support member 22 which is typically of a rolled steel. It can be seen that the back support member 22 has a large planar surface 24, first stepped sidewalls 26 connected to planar strip 30 generally parallel with the surface 24, with the planar strips merging with rolled side edges 28. Note in the exploded view of FIG. 3 that the upper edge of the back support member 22 has a curved top edge whereas the bottom rolled edge 28 is generally flat on the bottom and has a much tighter radius at the front lower edge.

The molded end pieces of FIG. 3 are shown as a lefthand molded end piece 20*a* and a righthand molded end piece 20*b*. Each molded end piece has a male connecting portion 36 which is inserted in the end of the back support member 22. As part of the male connecting portion 36, locking tabs 38 are arranged to contact the first sidewalls 26. Each locking tab includes a locking protrusion 40 aligned with and receivable within the locking port 27 of the back support member 22. Thus, when the male portion 36 is inserted within the back support member 22, locking protrusion 40 will be received within the locking port 27, thus anchoring the molded end piece in its final position in both of the first sidewalls 26. As can be appreciated, the locking ports 27 can easily be punched in the back support member and the cross section of the back support member can be formed on a continuous basis or as a preset operation and easily formed of steel or other suitable material. The point here is that the open ends of the back support member 22 makes it much easier to produce relative to trying to effectively close the ends of the back support member 22.

Each molded end piece has a male connecting portion 36 which is inserted in the end of the back support member 22. As part of the male connecting portion 36, locking tabs 38 are arranged to contact the first sidewalls 26. Each locking tab includes a locking protrusion 40 aligned with and receivable within the locking port 27 of the back support member 22. Thus, when the male portion 36 is inserted within the back support member 22, locking protrusion 40 will be received within the locking port 27, thus anchoring the molded end piece in its final position in both of the first sidewalls 26. As can be appreciated, the locking ports 27 can easily be punched in the back support member and the cross section of the back support member can be formed on a continuous basis or as a preset operation and easily formed of steel or other suitable material. The point here is that the open ends of the back support member 22 makes it much easier to produce relative to trying to effectively close the ends of the back support member 22.

Each molded end piece includes a rearwardly extending stop flange 42 having thereon parallel ribs 58 for centrally locating the back edge of the planar surface 24 between the ribs. The flange 42 forms a stop face as well as the shoulders 41 of the molded end pieces.

Each molded end piece has a hook member 43 projecting from the rear surface downwardly from the rear surface and defining a recess 44, which recess is sized for receiving a horizontal rail member of an office panel frame. This hook member 43 thus allows the panel to be secured at a lower edge to a horizontal rail member by placing the hook behind the frame member, with the frame member located within the recess 44. Adjacent the locking tab 38 is an integral spring clip 52 which forms a leaf type arm for releasably engaging the lower edge of a horizontal rail member when the panel element is inserted in a panel frame. The rearwardly extending flange 42 also includes a spring detente tab 54 having a camming member 56 on the free end thereof, with this spring detente tab facing outwardly for engaging a vertical frame member. In this way, either the integral spring clip 52 or the spring detente tab 54 can be used for releasably engaging the upper edge of an element to a panel frame once the hook 43 has been properly located behind a horizontal rail member of the panel frame.

Each molded end piece 20 also includes a panel element end defining portion 46 which provides a protective edge for the panel and this also cooperates with the panel edge area 50 for defining the thinned, notched area at the vertical edges of the panel used to conceal portions of the office panel frame.

Figure 4:
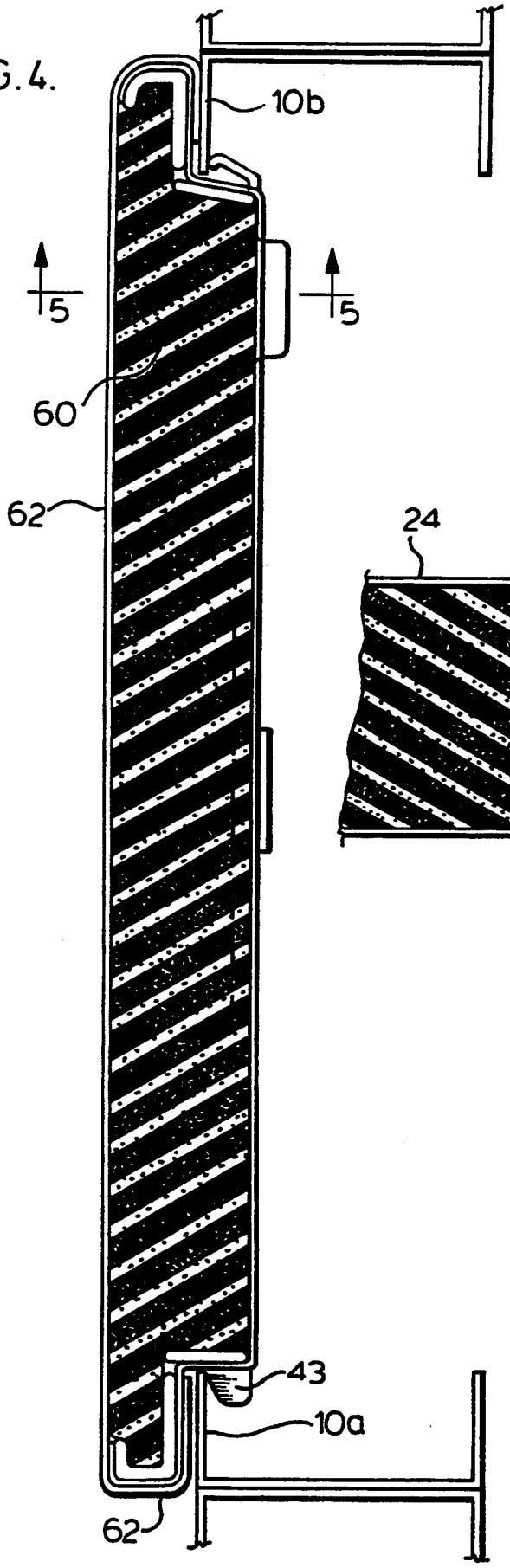
FIG. 4 is a vertical sectional view of an office panel element received in an office panel frame.
Figure 5:
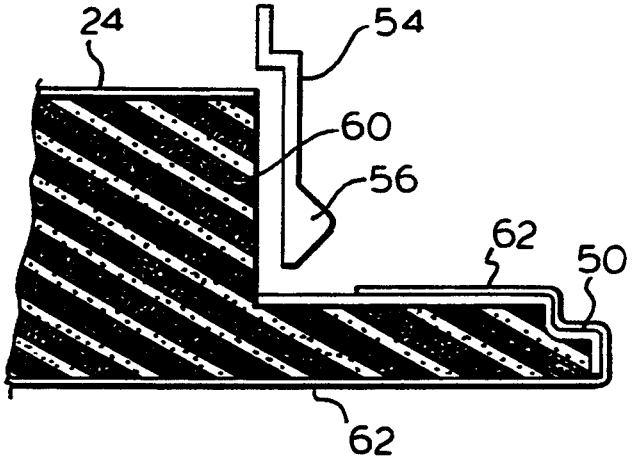
FIG. 5 is a sectional view taken along lines 5—5 of FIG. 4.
Figure 6:
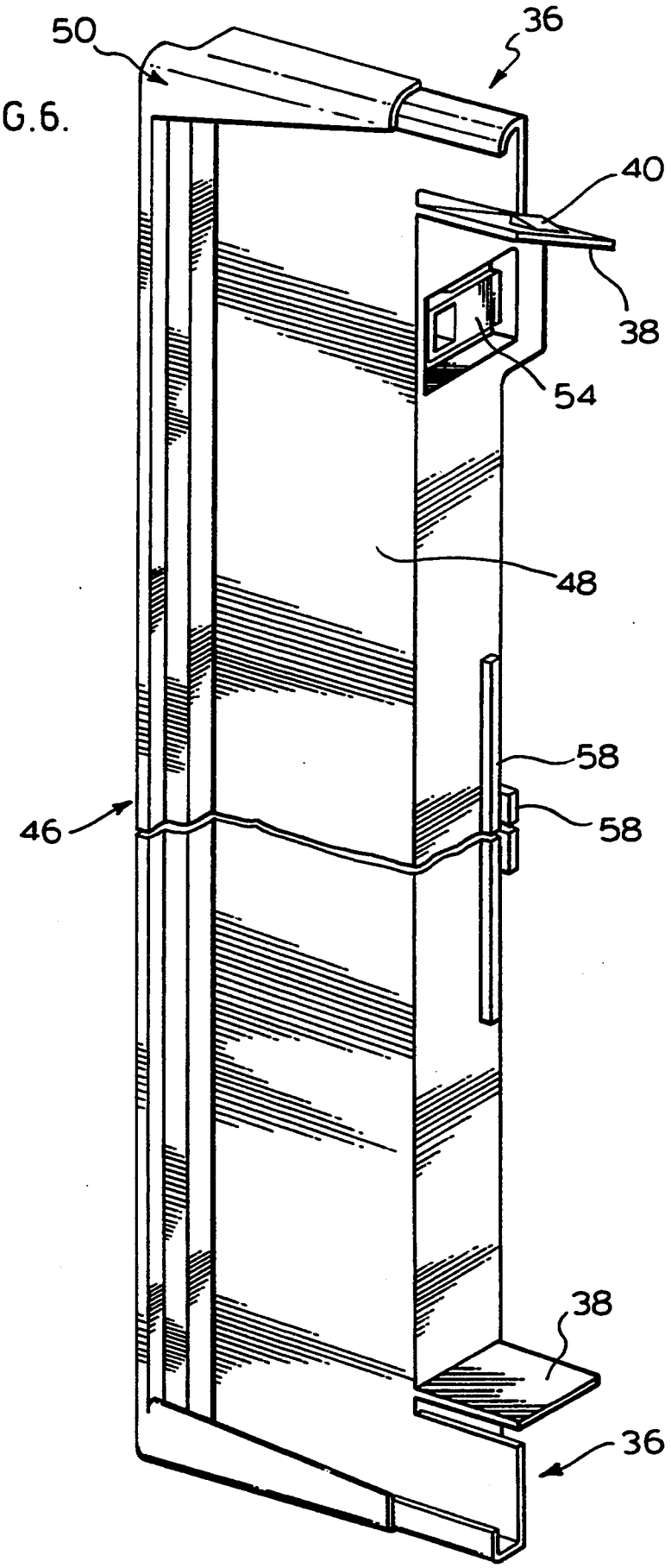
FIG. 6 is a perspective view of the molded end piece.

The vertical section of FIG. 4 shows an office panel element with the back support member and molded end pieces with sound absorbing material 60 located within the recess of the element. It also illustrates how a finish fabric or finish surface 62 has been applied over the panel element and has been attached to the rear surface of the office panel element. Thus, it can be seen that the finish surface has been wrapped around the top and bottom edges, as illustrated in FIG. 4, as well as around the side edges, as illustrated in FIG. 5.

Figure 7:
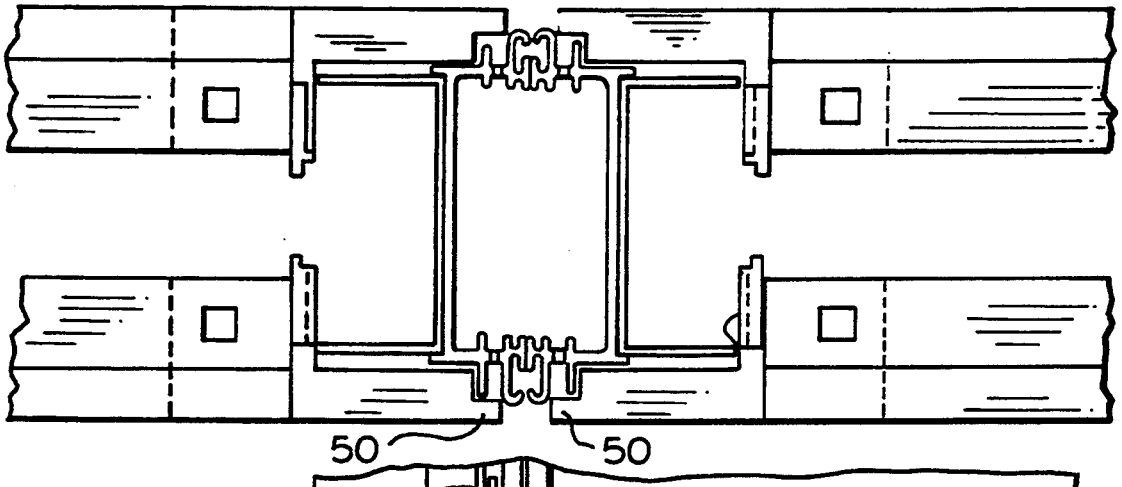
FIG. 7 is a horizonal sectional view showing how the office panel element effectively covers the exposed face of the vertical members of the office panel frame.
Figure 8:
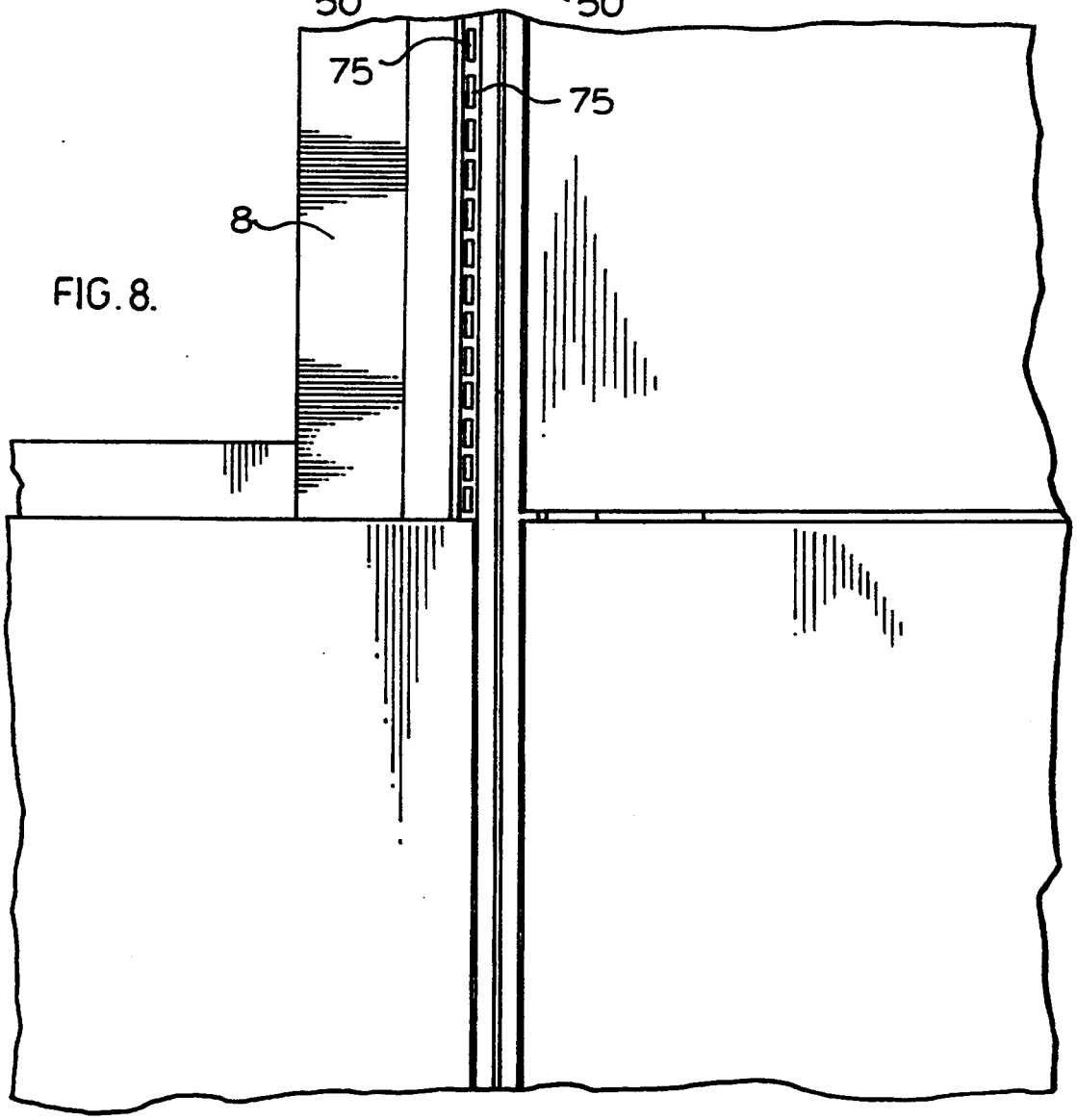
FIG. 8 is a front view showing the office panel elements of FIG. 7.

The present office panel element is shown attached to a panel frame in FIGS. 7 and 8 and it can be appreciated that the panel edge area 50 overlies the securing ports 75 provided in the vertical edge members of the office panel frame. It can also be seen that the molded end pieces either side of the panel provide an edge region of the office panel element which conceals the frame members.

Although the office panel element has been described with respect to a recess for receiving sound absorbing material, it is also possible to have the back support member 22 designed to provide a front support surface over which a finish material is applied. This may be the case where sound absorption is not necessary or desired. In this case, the cross section of the support member 22 can change, however, it would still be easier to use the molded end pieces having a suitable front face for extending the support face of the panel while including the specific arrangements for allowing releasable attachment of the elements to the frame of an office panel.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An office panelling system having a plurality of interconnected office panels wherein each office panel is defined by a frame in combination with office panel elements releasably supported by the frame, said office panel elements defining finished surfaces of the office panel and wherein each office panel element comprises two plastic molded end pieces and a back support member having a central front opening recess, said molded end pieces being received either end of said back support member and cooperate with said back support member to collectively form a frame structure about said central front opening recess, a filler material retained in and generally filling said front opening recess a decorative material secured over said frame structure and over said filler material to define the finished surface of the office panel element, and wherein each office panel element includes means for releasably supporting said panel element in one of said office panel frames.

2. An office panelling system as claimed in claim 1 wherein said back support member is generally of a constant cross sectional shape and said molded end pieces are slidably received in said back support member.

3. An office panelling system as claimed in claim 1 wherein said molded end pieces include locking members and said back support member includes locking recesses therein which receive said locking members of said molded end pieces, said locking members cooperating with said locking recesses to retain the molded end pieces secured to said back support member.

4. An office panelling system as claimed in claim 1 wherein said means for releasably supporting said panel element in one of said office panel frames are provided as an integral part of each molded end piece.

5. An office panelling system as claimed in claim 4 wherein said molded end pieces include locking members and said back support member includes locking recesses therein which receive said locking members of said molded end pieces, said locking members cooperating with said locking recesses to retain the molded end pieces secured to said back support member.

6. An office panelling system as claimed in claim 4 wherein said means for supporting said panel element in one of said panel frames includes a spring detente arrangement which engages part of the frame of said panelling system when the element is secured on said frame.

7. An office panelling system as claimed in claim 4 wherein each frame has a series of horizontal rails extending thereacross, and wherein said means for supporting said panel element includes a lower hook arrangement and an upper spring detente provided in each molded end piece, said lower hook arrangement engages one of said rails of an office panel frame and said upper spring detente in each molded end piece engages one of said rails of the panelling system.

8. An office panelling system as claimed in claim 7 wherein said upper spring detente is a resiliently mounted tab having a camming surface thereon for engaging a rail of the office panel frame.

9. An office panelling system as claimed in claim 8 wherein said upper spring detente includes a top facing spring detente and a side outwardly facing spring detente each of which is for engaging a frame member of the office panel.

10. An office panelling system as claimed in claim 1 wherein said molded end pieces have a projecting portion of greatly reduced depth relative to said back support member and defines one edge of said element.

11. An office panelling system as claimed in claim 10 wherein said projecting portion is further reduced at the edge thereof to define a narrow edge strip.

12. An office panelling system as claimed in claim 11 wherein said narrow edge strip is of a width of less than $\frac{3}{8}$ of an inch.

* * * * *